US005092806A

United States Patent [19]

Brown

[11] Patent Number: 5,092,806

[45] Date of Patent: Mar. 3, 1992

[54] PROFILE DESIGN DISPLAY MODEL

[76] Inventor: Robert T. Brown, P.O. Box 221, Welcome, N.C. 27374

[21] Appl. No.: 396,611

[22] Filed: Aug. 21, 1989

[51] Int. Cl.[5] ..... A63H 33/14; G09F 1/08

[52] U.S. Cl. ..... 446/88; 40/538; 40/160

[58] Field of Search ..... 446/88, 93, 94, 95, 446/87; 40/160, 538

[56] References Cited

U.S. PATENT DOCUMENTS

| | | | |
|---|---|---|---|
| 1,541,504 | 6/1925 | Hunter | 40/538 |
| 1,570,729 | 1/1926 | Clements | 40/538 X |
| 2,870,558 | 1/1959 | Fuller | 40/538 |
| 3,822,494 | 7/1974 | Zivica | 40/160 X |

FOREIGN PATENT DOCUMENTS

| | | | |
|---|---|---|---|
| 886245 | 8/1953 | Fed. Rep. of Germany | 40/538 |
| 9910 | of 1906 | United Kingdom | 40/538 |
| 21300 | of 1909 | United Kingdom | 40/538 |
| 1569205 | 6/1980 | United Kingdom | 446/88 |
| 2116122 | 9/1983 | United Kingdom | 40/160 |

*Primary Examiner*—Mickey Yu

[57] ABSTRACT

A display model resembling a vehicle that has been sectioned longitudinally by a verticle plane. The display model being constructed of a plastic or other material suitable for moulding, incorporates a simulated vehicle interior portion incorporated into the baseplate. Simulated seat and steering wheel and other interior components are also included within the display models interior. In addition, the display model may also include functional features, such as, an opening hood and door and illuminable lights.

8 Claims, 2 Drawing Sheets

PROFILE DESIGN DISPLAY MODEL

BACKGROUND—FIELD OF INVENTION

This invention relates to an updated design in the field of display models and model kits.

BACKGROUND—DESCRIPTION OF INVENTION

Display model enthusiast are commonly faced with similiar inconveniences, such as, the high cost of building a larger model and no play to display them.

Before manufacturers produced display models and model kit replicas of automobiles, boats and aircraft. The model kit replicas, being of a small scale, often required many uneasy-to-see parts which sometimes made the models difficult to assemble. Also in manufacturing display models and model kits of the past, manufacturers had to produce two identical sides of a display model, which means more time and money to produce the moulds and dies.

There are a number of disadvantages to the type of display models and kits which are presently offered, such as;

A. Small display models and model kits can be costly.

B. When working with small display model kits, it is often difficult to handle small pieces for assembly.

C. Precise details on display models and kits are sometimes difficult to produce, due to the fact that manufacturers have to produce two identical sides.

D. After completion of a model kit, nothing else can be done with the finished model except leave it sitting around.

OBJECTS AND ADVANTAGES

Accordingly, besides the points and discussion made in the above statements, there are several objects and advantages present in my invention, such as:

A. Larger profile design display models and kits can be bought at basically the same price as small models available now.

B. It is easier for a model builder to assemble a larger model, due to the fact that it has larger, easier to handle pieces.

C. The production of profile models would be more easily manufactured, and manufacturers could pay more attention to detail on one side by not having to duplicate the opposite side.

D. A larger profile model allows more space for extras such as, lighting and moving parts.

E. A completed profile design display model can be incorporated into any decor and can be used as a working part of the surroundings.

Further objects and advantages of a profile design display model, such as, aircraft, automobile or boats, can be easily manufactured with no addition cost to produce.

There would also be no additional cost to the builder who wants to build a larger, more detailed model. Still further objects and advantages will become apparent from a consideration of the ensuing description and drawings.

DRAWING FIGURES

In the drawings, the figures below explain the view of each picture.

REFERENCE NUMERALS

| | |
|---|---|
| 2 Chassis | 4 Wheels |
| 6 Lights | 8 Windshield |
| 10 Hood | 12 Rear Hatch |
| 14 Door | 16 Rear Section |
| 18 Base Plate | 20 Front Section |
| 22 Top | 24 Wheel Covers |
| 26 Interior Portion | 28 Steering Wheel |
| 30 Hinges | 32 Seat |

DESCRIPTION—FIGS. 1 TO 3

Figure 1:
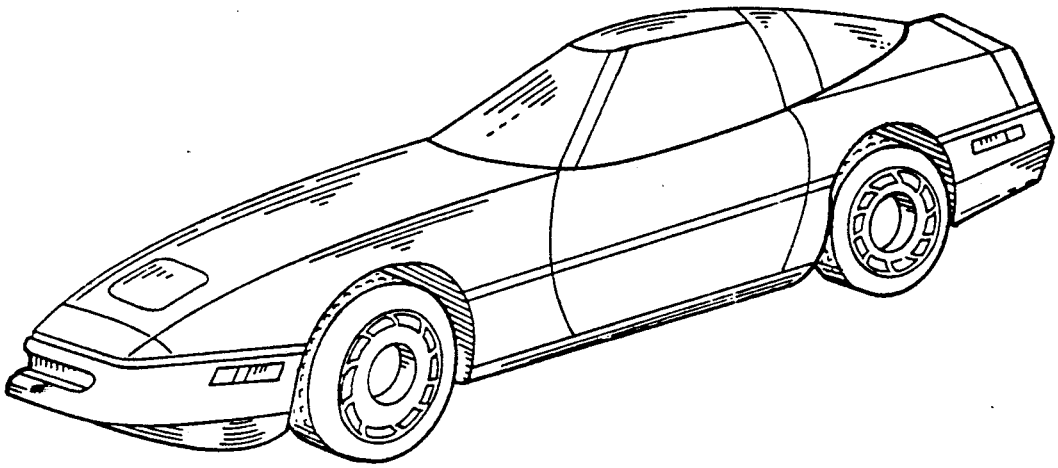
FIG. 1 shows a three-quarter angle view from the front.
Figure 2:
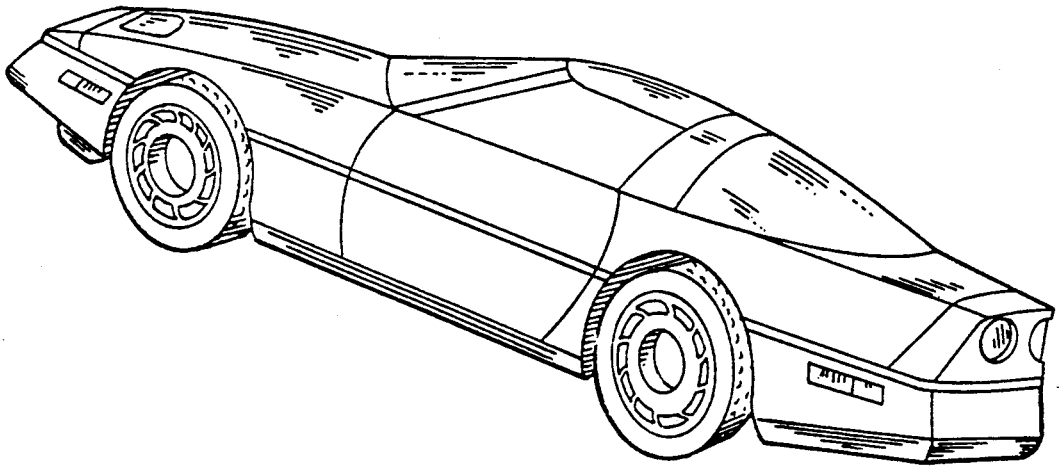
FIG. 2 shows a three-quarter angle view from the rear.

Referring to the drawings FIG. 1 and FIG. 2, illustrate perspective three-quarter views from the front and rear of the model as being placed on a wall or other vertical surface.

Figure 3:
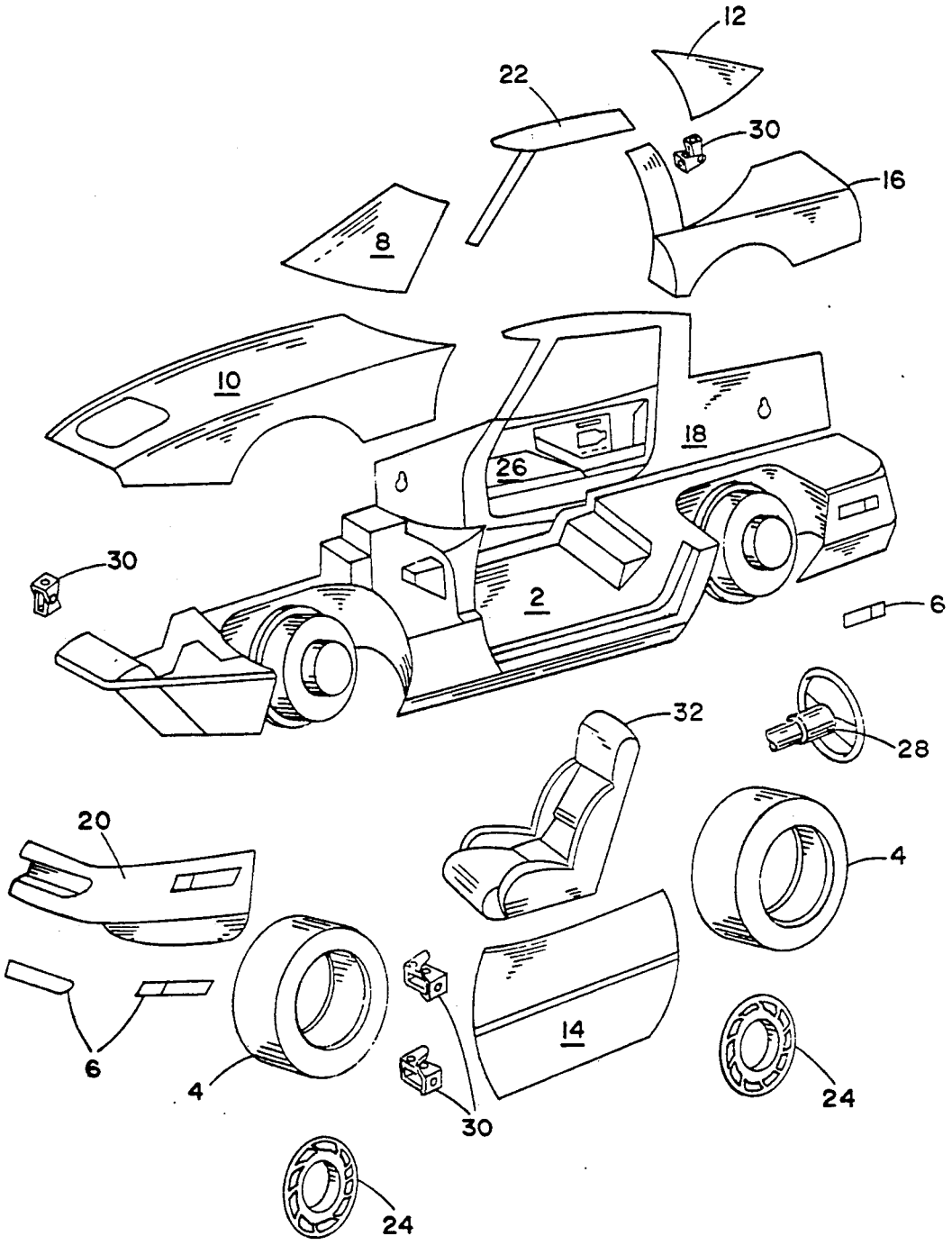
FIG. 3 shows a breakdown of the model, consisting of all major components incorporated in a profile design display model.

FIG. 3 illustrates a breakdown of the model, consisting of all major components incorporated into a profile display model. All major components, of the model would be moulded from a type of plastic or any other material suitable for moulding.

The base plate 18 consist of a completely flat planar side to be placed against a wall or other flat vertical surface and the other side of the base plate 18 consist of a raised i.e. three dimensional surface of a simulated interior portion 26 of the interior of the model. As assembly of the model beings the chassis 2 that has been sectioned longitudinally by a vertical plane is fastened to the base plate 18 with an adhesive or other suitable means for securing it. The interior, such as the seat 32, steering wheel 28 and other appropriate interior components would then be placed and secured in their perspective areas on the chassis 2 and the base plate 18.

Lights 6 are then placed and secured in the perspective outer body skins; at this time they may also be wired to be illuminated for a more realistic appearance. Outer body skins, such as, the rear section 16 and top 22 are attached and secured to the chassis 2 and base plate 18, followed by the windshield 8. The front section 20 can now be attached followed by the hood 10, hatch 12, and door 14 which may also be hinged via hinges 30 for functionability. To complete the model wheels 4 and wheelcovers 24 are fastened on the model. A profile design display model can be appreciated by all—as it is proudly displayed on a wall or other vertical surface.

Operation

The manner of using profile design display model has the same underlying purposes as todays full-view display models and model kits with the greater advantage of being able to display a profile design model by hanging it on a wall or other vertical surface. Enhancing a profile design model even further could be accomplished by placing a poster or decorative member behind the model. While being displayed the models wheels 4, could be operated and lights 6 may also be illuminated for a realistic appearance.

SUMMARY, RAMIFICATIONS, AND SCOPE

Accordingly, the reader will see that a profile design display model can be displayed differently than in the manner of current display models. The model can be easily manufactured due to the fact that only one side has to be produced and concentration on detail is allowed. Larger kits can be bought at the cost of the conventional small full view models offered at present. Furthermore, the profile design display model has additional advantages in that significantly larger, more detailed display models and kits can be bought at the same price as smaller models and kits:

greater ease of building the larger profile model is allowed because of easy handling;

manufacturing of profile models will be easier to produce; manufacturers only have to make one very detailed side:

more could be offered on large models (such as lights, moving parts);

it can be hung on the wall backed by a poster to create a certain effect or in any manner wished so that it is not inactive in its setting.

Although the description above contains many specificities, these should not be contrued as limiting the scope of the invention but as merely providing illustrations of some of the presently preferred embodiments of this invention. For example, the profile design display model can be of a different species, such as, boats, planes, etc.; the model can have varying special features, etc.

Thus the scope of the invention should be determined by the appended claims and their equivalents, rather than by the examples given.

I claim:

1. A kit for forming a display model comprising:

a) a base plate having a planar surface on one side capable of being mounted on a support surface, and on an opposite side having simulated vehicle components thereon forming a simulated interior of a vehicle;

b) a chassis, said chassis being attachable to said base plate, said chassis further being sectioned along a longitudinally extending vertical plane, and attachable to said side having said simulated vehicle interior, said chassis including an interior portion with simulated seats and steering wheel attached thereto;

c) simulated vehicle wheels, said wheels being attachable to said chassis;

d) simulated vehicle doors, said doors being attachable to said chassis;

e) simulated vehicle hood and rear hatch, said hood and rear hatch being attachable to said chassis, and also being sectional along said plane.

2. The kit as defined in claim 1, wherein said hood, hatch, and doors are movably attachable to said chassis by respective hinges.

3. The kit as defined in claim 1 further including outer body skins integrally attachable to said chassis.

4. The kit as defined in claim 3 further including illuminable light fixtures attachable to said outer body skins.

5. A display model comprising:

a) a base plate having a planar surface on one side capable of being mounted on a support surface, and on an opposite side having simulated vehicle components thereon forming a simulated interior of a vehicle:

b) a chassis, said chassis being sectioned along a longitudinally extending vertical plane, and attached to said side having said simulated vehicular interior, said chassis including an interior portion with simulated seats and steering wheel attached thereto;

c) simulated vehicle wheels, said wheels being attached to said chassis;

d) simulated vehicle doors, said doors being attached to said chassis;

e) simulated vehicle hood and rear hatch, said hood and rear hatch being attached to said chassis, and also being sectional along said plane.

6. The display model as defined in claim 5, wherein said hood, hatch and doors are movably attached to said chassis by respective hinges.

7. The display model as defined in claim 5 further including outer body skins integrally attached to said chassis.

8. The display model as defined in claim 7 further including illuminable light fixtures attached to said outer body skins.

* * * * *